United States Patent [19]

Rothenpieler et al.

[11] Patent Number: 4,953,806

[45] Date of Patent: Sep. 4, 1990

[54] WINDING REEL FOR ROLLED STRIP

[75] Inventors: Manfred Rothenpieler, Siegen; Wolfgang Moos, Freuztal, both of Fed. Rep. of Germany

[73] Assignee: SMS Schloemann-Siemag Aktiengesellschaft, Dusseldorf, Fed. Rep. of Germany

[21] Appl. No.: 338,404

[22] Filed: Apr. 12, 1989

Related U.S. Application Data

[63] Continuation of Ser. No. 98,777, Sep. 17, 1987, abandoned, which is a continuation of Ser. No. 823,622, Jan. 29, 1986, abandoned.

[51] Int. Cl.[5] ..... B21C 47/30

[52] U.S. Cl. ..... 242/72.1; 242/72 R

[58] Field of Search ..... 242/72 R, 72.1, 68.4, 242/81

[56] References Cited

U.S. PATENT DOCUMENTS

| | | | |
|---|---|---|---|
| 2,916,224 | 12/1959 | Larsen | 242/72.1 X |
| 2,922,593 | 1/1960 | Greenberger | 242/81 X |
| 3,507,455 | 4/1970 | Andersson | 242/72.1 |
| 4,210,294 | 7/1980 | Jansen | 242/72.1 |

FOREIGN PATENT DOCUMENTS

| | | | |
|---|---|---|---|
| 3028607 | 2/1982 | Fed. Rep. of Germany | 242/72 R |
| 46-43974 | 12/1971 | Japan | 242/72.1 |

*Primary Examiner*—Daniel P. Stodola

*Attorney, Agent, or Firm*—Toren, McGeady & Associates

[57] ABSTRACT

A reel for winding and unwinding rolled strip into a reel shaft with a reel drum axially movable in a stationary reel housing. A positioning drive formed by a non-rotatable but axially movable piston-cylinder unit is utilized for spreading apart the segments of the reel drum. The segments are maintained in the spread-apart position by the force of a spring. A displacement drive formed by a piston-cylinder unit is used for axially moving the reel shaft. This reel makes it unnecessary to axially move the reel housing including positioning drives, drive motor, coupling and gear assembly by means of a displacement drive. Also, the provision of a rotary pressure supply for spreading the segments is unnecessary.

7 Claims, 3 Drawing Sheets

WINDING REEL FOR ROLLED STRIP

This is a continuation of Ser. No. 07/098,777, abandoned, filed Sept. 17, 1987, which in turn is a continuation of Ser. No. 06/823,622, filed Jan. 29, 1986, abandoned.

BACKGROUND OF THE INVENTION

1. Field of the Invention

The present invention relates to a reel for winding and unwinding rolled strip. The reel includes a drum composed of several segments which can be spread apart and have conically formed sliding surfaces with which they rest against a reel shaft. The reel shaft is rotatably mounted in a reel housing. A plunger connected to the drum segments by means of a connecting flange is guided in the reel shaft. A positioning drive is utilized to obtain a relative axial movement between the reel shaft and the plunger connected to the reel segments which axial movement causes the spreading of the segment. A displacement drive is used to move the reel drum in and out relative to the strip collar and/or to effect the adjustment relative to the strip center.

2. Description or the Prior Art

European Patent No. 004,854 discloses a rolled strip reel of the aforedescribed type. The reel has a positioning drive rigidly connected to and rotating with the reel shaft. During operation, the positioning drive must constantly be supplied with pressure means in order to keep the segments in the spread apart position. This makes necessary rotary pressure means supplies which are expensive and malfunction prone.

In the known reel for rolled strip, the entire reel housing must be capable of displacement on rails or other guide means in the direction of the reel shaft to be able to carry out the entry travel into the coil (preferably in double cone reels) and the compensation of the strip center mismatch. The size of the displacement drive must be dimensioned so that the heavy reel housing including reel, positioning drive, drive motor, coupling and gear assembly can be moved in an accurate manner. As a result, expensive guide means are necessary for precise handling of these great loads. In addition, large and expensive displacement drives are necessary.

German Offenlegungsschrift No. 3,028,607 describes a reel for rolled strip in which the pusher is pretensioned by means of the force of a spring and thereby held in the spreading position. The segments of the drum are returned from their spreading position by means of a stationary and nonrotatable positioning drive.

It is the primary object of the present invention to improve a reel for winding and unwinding rolled strip of the above-described type. Specifically, a reel is to be provided which, with small and inexpensive drives and without the requirement of supplying pressure means to rotating components, ensures a simple return of the drum segments from the spread-apart position, optimum travel of the reel drum into and out of a coil, and a reliable adjustment relative to the strip center.

SUMMARY OF THE INVENTION

In accordance with the present invention, the reel for winding and unwinding rolled strip has a reel shaft which is axially movably mounted in a stationary reel housing. A positioning drive which acts on the reel shaft for spreading-apart the segments of a drum includes a piston cylinder unit which is axially slidable, but non-rotatable relative to the stationary reel. A compression spring serves to keep the segments in the spread-apart position. A displacement drive including a piston cylinder unit is used for the axial displacement of the reel shaft.

The drives of the reel for winding and unwinding rolled strip in accordance with the invention may be small and inexpensive because it is not necessary to axially displace the entire reel housing, but only the reel shaft. Since the loads to be displaced are small, it is possible in an inexpensive manner to obtain an accurate movement of the reel drum and an exact adjustment relative to the strip center. Also, it is not necessary to supply pressure means to rotating components because segments are used which are maintained in the tensioned state by means of the force of a spring.

The reel shaft is axially movably mounted in a tubular drive shaft which, in turn, is mounted axially immovably but rotatable in the reel housing. Splines on the reel shaft engage in grooves defined in the tubular drive shaft, so that the reel shaft and the drive shaft rotate together. The drive shaft is provided with a gear which is in engagement with a drive gear of a stationary gear assembly.

In accordance with another feature of the invention, the positioning drive has a cup-shaped attachment which surrounds the end of the reel shaft remote from the reel drum. The end of the attachment is mounted in such a way that virtually no moments are transmitted to the reel shaft, while frictional engagement exists in axial direction, so that an axial coupling is achieved which permits rotation of the reel shaft. The displacement drive acts on the positioning drive and, through the positioning drive, the displacement drive acts on the reel shaft.

The positioning drive may be axially movable relative to the reel housing and the displacement drive may be stationary.

It has been found useful to connect the piston rod of the positioning drive to the piston rod of the displacement drive. However, it is also possible to mount the pistons of the displacement drive and of the positioning drive on a common piston rod.

It is recommended that the cup-shaped attachment of the positioning drive is attached to the cylinder of the drive and that, in the spread-apart state of the reel drum, the head of the positioning drive is lifted off from the head of the plunger.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
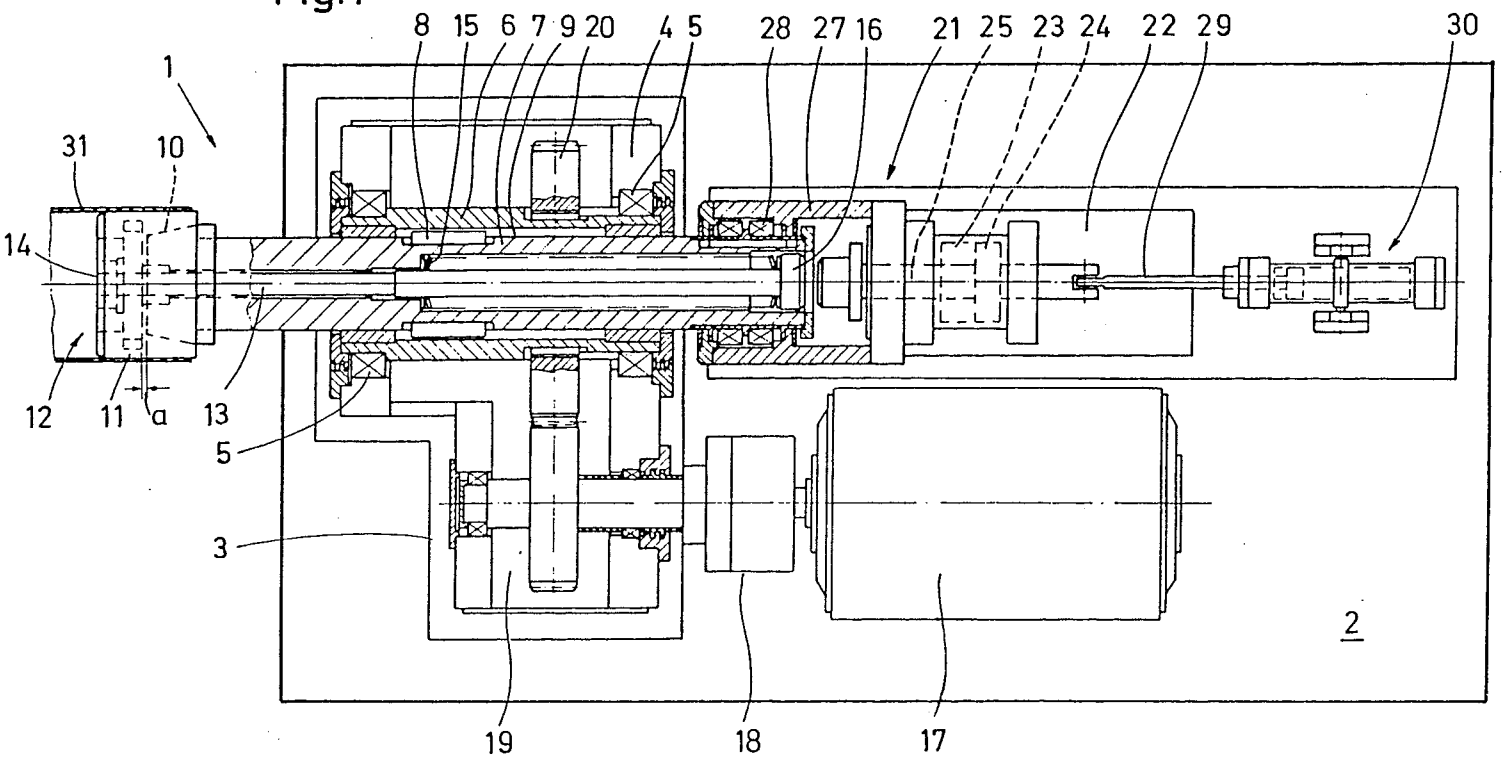
FIG. 1 is a sectional view of a reel for winding and unwinding rolled strip in accordance with the present invention, illustrated in the operating position.

FIG. 1 shows a reel 1 which is suitable for the winding and unwinding of rolled strip. The reel 1 has a reel housing 3 mounted on a base frame 2. In a support stand 4 of reel housing 3 are seated roller bearings 5 in which a tubular drive shaft 6 is rotatably but axially immovably supported. A splined reel shaft 7 is axially movably mounted in tubular drive shaft 6. Splines 8 of reel shaft 7 engage in grooves 9 formed in tubular shaft 6, so that splined reel shaft 7 and tubular drive shaft 6 rotate together.

The free end of reel shaft 7 has conically shaped sliding surfaces 10 on which are resting the segments 11 of reel drum 12. A plunger 13 is guided in reel shaft 7. This guidance permits a relative axial displacement between reel shaft 7 and plunger 13. Plunger 13 is connected to segments 11 by means of a connecting flange 14. The conical surfaces 10 are moved back and forth relative to the segments 11 by moving axially the reel shaft 7 while the plunger 13 remains stationary in axial direction, so that the reel drum 12 is being spread apart and returned from the spread apart position by the movement of the reel shaft 7.

At the end of the reel shaft 7 facing away from the reel drum 12, the reel shaft 7 has an internal diameter which exceeds the external diameter of plunger 13. In the free space between plunger 13 and reel shaft 7 is received a compression spring 15 which rests against reel shaft 7 on one end and against a head 16 of plunger 13 on the other end. Through reel shaft 7, the spring force maintains the segments 11 in the spread-apart position, with the plunger 13 remaining stationary in axial direction.

The reel drum 12 is driven by a motor 17 through coupling 18, gear assembly 19, gear 20 mounted on drive shaft 6 and reel shaft 7.

The reel drum 12 is returned from the spread-apart position by axially moving reel shaft 7 against the force of compression spring 15. At the same time, plunger 13 remains axially fixed. This has the advantage that segments 11 also remain axially fixed during the spreading procedure, so that no additional mismatch from the strip center occurs during the exchange of the coil. A non-rotating, axially movable positioning drive 21 is used to act on reel shaft 7 for returning the segments of drum 12 from the spread-apart position. The positioning drive 21 is connected to base frame 2 through a carriage 22. The positioning drive 21 includes a cylinder 23 which houses a piston 24. A head 26 located opposite head 16 of plunger 13 is provided on the free end of piston rod 25.

To cylinder 23 is attached a cup-shaped attachment 27 which engages the end of the reel shaft 7 remote from reel drum 12 through bearings 28 which permit rotary motion and result in a frictional coupling in axial direction.

The end of piston rod 25 remote from head 26 is connected to a piston rod 29 of a displacement drive 30 which is rigidly mounted on base frame 2.

In the operating position illustrated in FIG. 1, reel drum 12 is driven by motor 17. Head 26 of positioning drive 21 is separated from head 16 of plunger 13. Compression spring 15 maintains reel drum 12 in the spread-apart position. In this position, displacement drive 30 can act through axially movable positioning drive 21 on reel shaft 7 and plunger 13 in such a way that reel drum 12 is accurately aligned relative to the strip center during operation without carrying out a spreading procedure.

Figure 2:
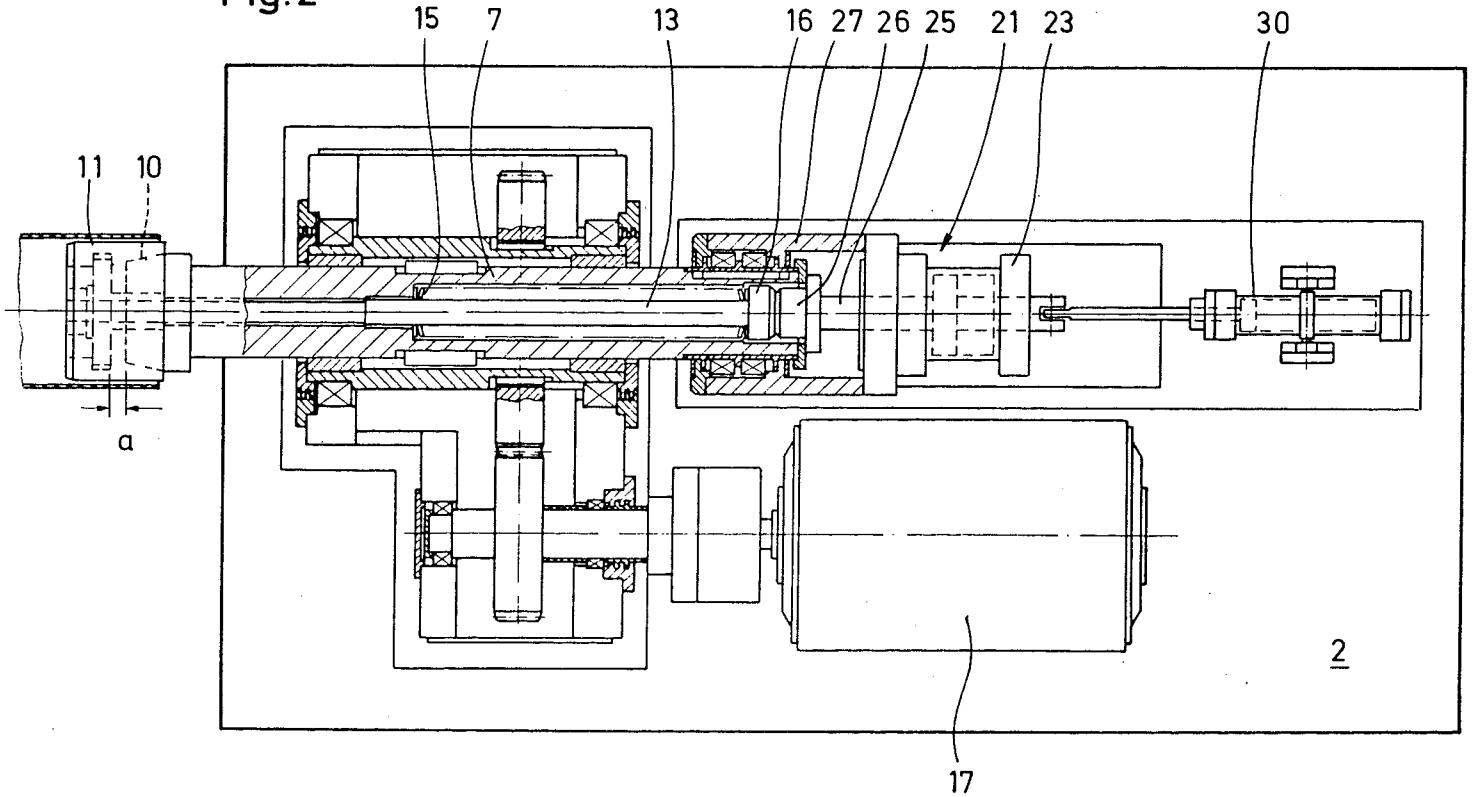
FIG. 2 is a sectional view of the reel illustrated in FIG. 1 with the segments of the reel drum returned from the spread-apart position.

In the position illustrated in FIG. 2 the motor 17 has been stopped. By actuating the positioning drive 21, the reel shaft 7 is to be moved axially through cup-shaped attachment 27 toward positioning drive 21. However, in order to maintain plunger 13 in an axially fixed position, the displacement drive 30 is actuated in the opposite direction of positioning drive 21. Displacement drive 30 is axially moved to the same extent as cylinder 23 of positioning drive 21 is moved. As a result, reel shaft 7 and plunger 13 initially remain axially fixed. Displacement drive 30 is switched off as soon as head 26 of positioning drive 21 and head 16 of plunger 13 have come into contact with one another. Accordingly, plunger 13 remains axially fixed while, as positioning drive 21 continues to operate, reel shaft 7 is moved axially toward the positioning drive 21. The relative movement between reel shaft 7 and plunger 13 causes the return of the segments 11 from the spread-apart position.

Figure 3:
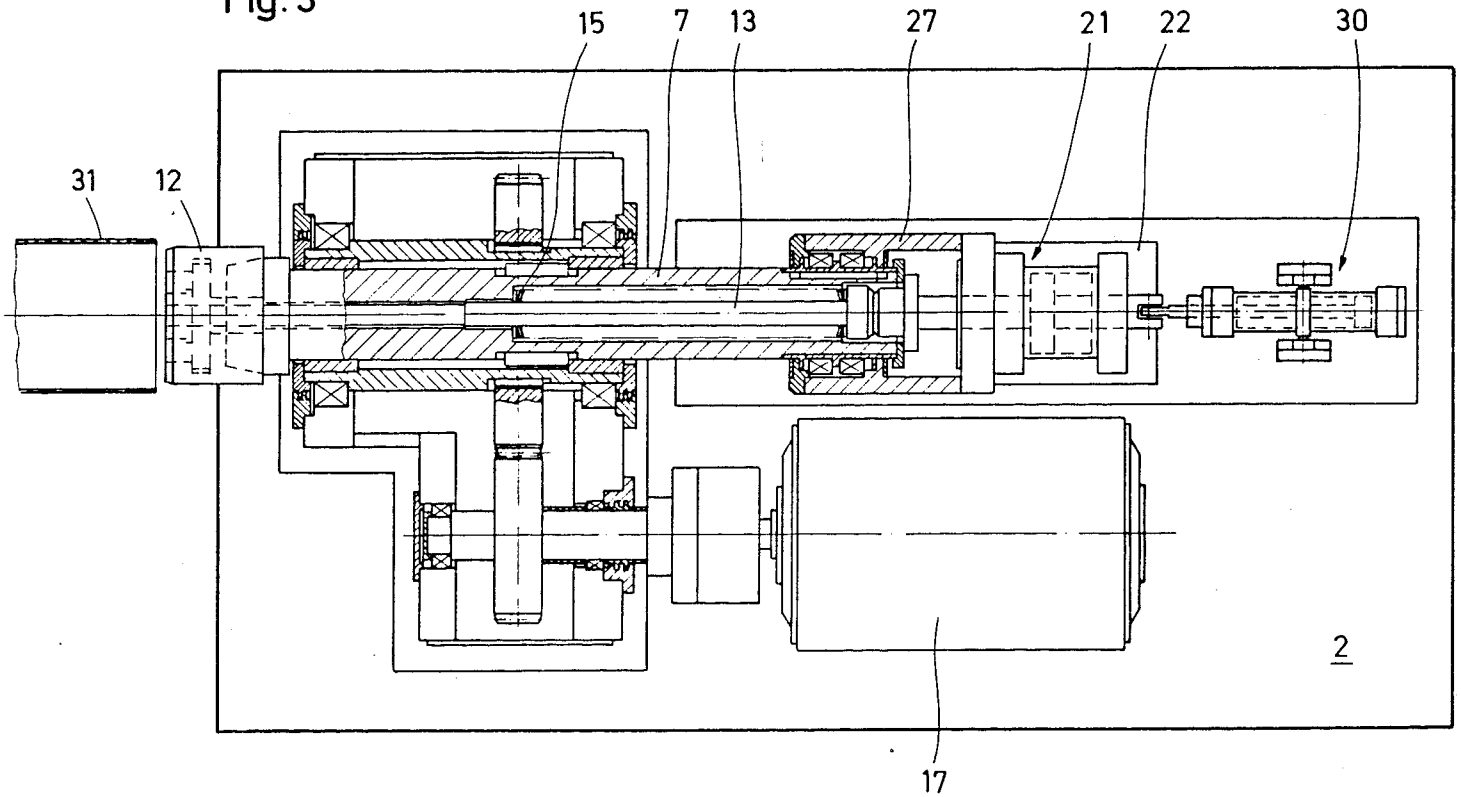
FIG. 3 is a sectional view of the reel illustrated in FIG. 1, illustrated in the position retracted from the coil.

FIG. 3 illustrates reel drum 12 after it has been moved out of coil 31. Positioning drive 21 remains in the position for returning the segments 11 from the spread-apart position, while displacement drive 30 has axially moved positioning drive 21 on carriage 22. Through cup-shaped attachment 27, reel shaft 7 and plunger 13 were moved together with positioning drive 21 and, thus, reel drum 12 was moved axially out of coil 31.

The reel for winding and unwinding rolled strip in accordance with the present invention is exceptionally suitable for operation of double cone reels with strip center control. For setting up a double cone reel it is merely necessary to assemble two reels according to the invention opposite one another. It is also possible to use one of the double cone reels without drive 17 through 20.

It is also possible to maintain the reel shaft 7 in an axially fixed position and to move axially the plunger 13 in order to return the reel drum 12 from the spread-apart position. The strip center mismatch caused thereby would have to be continuously compensated for by means of displacement drive 30.

While a specific embodiment of the invention has been shown and described in detail to illustrate the application of the inventive principles, it will be understood that the invention may be embodied otherwise without departing from such principles.

We claim:

1. A reel for winding and unwinding rolled strip on a coil, the strip having a center, comprising a drum including a plurality of segments movable between a first position of rest and a second spread-apart position, said segments defining conically shaped sliding surfaces, a stationary reel housing, a tubular drive shaft mounted rotatably and axially immovably in said housing, a tubular reel shaft having an axis and an end facing said drum, said end defining conically shaped surfaces contacting said sliding surfaces of said segments, said tubular reel shaft mounted in said tubular drive shaft, said tubular reel shaft having axially extending splines and said tubular drive shaft defining axially extending grooves engaged by said splines, so that said tubular reel shaft is rotatable together with said tubular drive shaft in said reel housing and axially slidable relative to said tubular drive shaft, a plunger mounted in said tubular reel shaft, a flange attached to said plunger for connecting said plunger to said segments, a compression spring surrounding said plunger, said spring acting on said tubular reel shaft and said plunger in axial direction for biasing said segments into said spread-apart position, wherein said segments are moved between said first and second position by an axial movement of said tubular reel shaft, a non-rotating, axially movable positioning drive formed by a piston-cylinder unit including a first piston rod, the positioning drive effecting a relative axial movement between said tubular reel shaft and said plunger for moving said segments from said spread-apart position against the force of said compression spring to said position of rest and a stationary displacement drive formed by a piston-cylinder unit including a second piston rod for axially moving said drum in and out relative to the coil and to effect an adjustment relative to the strip center, said first and second piston rods connected to each other and configured to hold said plunger and said segments in fixed axial position during the movement of said segments between said first and second position.

2. A reel according to claim 1, comprising, a gear mounted on said tubular drive shaft for engagement by a drive gear of a stationary gear assembly.

3. A reel according to claim 1, wherein said positioning drive includes means for connecting said positioning drive with said reel shaft in axial direction, said connection means permitting rotation of said reel shaft, and wherein said displacement drive axially moves said reel shaft and said plunger by exerting an axial force on said positioning drive.

4. A reel according to claim 3, comprising a common piston rod for the pistons of said piston-cylinder units of said positioning drive and of said displacement drive.

5. A reel according to claim 3, wherein said means is a cup-shaped attachment connected to the cylinder of said piston-cylinder unit of said positioning drive, said cup-shaped attachment surrounding an end of said reel shaft remote from said reel drum.

6. A reel according to claim 1, wherein said positioning drive is non-rotatable but axially movable relative to said reel housing, and wherein said displacement drive is stationary.

7. A reel according to claim 1, comprising a head member attached to an end of said plunger remote from said reel drum and a head member attached to the piston of said piston-cylinder unit of said positioning drive, said head members facing one another in the axial direction, wherein said head members are spaced apart when said segments are in said spread-apart position.

* * * * *